US005566529A

United States Patent [19]

Sireix

[11] Patent Number: 5,566,529

[45] Date of Patent: Oct. 22, 1996

[54] PROCESS FOR MANUFACTURING A TUBULAR PACKAGE, AND PACKAGE OBTAINED BY THE IMPLEMENTATION OF THE PROCESS

[76] Inventor: Georges Sireix, 9 bis rue St Marc-68400, Riedisheim, France

[21] Appl. No.: 391,540

[22] Filed: Feb. 21, 1995

[30] Foreign Application Priority Data

Feb. 22, 1994 [FR] France ..... 94 02003

[51] Int. Cl.[6] ..... B65B 61/18

[52] U.S. Cl. ..... 53/412; 53/489; 53/487; 53/449; 53/478

[58] Field of Search ..... 53/489, 487, 485, 53/412, 297, 319, 330, 329.2, 329.3, 449, 478; 215/2; 156/69

[56] References Cited

U.S. PATENT DOCUMENTS

| | | | |
|---|---|---|---|
| 4,599,123 | 7/1986 | Christensson | 53/489 |
| 4,888,935 | 12/1989 | Wythoff | 53/329.3 |
| 5,080,233 | 1/1992 | Wyberg | 53/412 |
| 5,188,253 | 2/1993 | Poore et al. | 215/2 |

FOREIGN PATENT DOCUMENTS

| | | | |
|---|---|---|---|
| 46092 | 1/1911 | Austria | 53/297 |
| 1565609 | 2/1969 | France . | |
| 2523073 | 9/1983 | France | 53/329.3 |
| 2718574 | 2/1978 | Germany . | |
| 2073156 | 10/1981 | United Kingdom . | |

*Primary Examiner*—John Sipos
*Assistant Examiner*—John Paradiso
*Attorney, Agent, or Firm*—Kane, Dalsimer, Sullivan, Kurucz, Levy, Eisele and Richard, LLP

[57] ABSTRACT

After manufacturing, by known means, a tubular body (30), the successive drawing of two pieces is carried out in order to form two cups (50, 70). Two cups (50, 70) are simultaneously inserted into the body (30) with the drawing tool and their lateral parts (51, 71) are joined to the inner face of the body (30). The prescoring (32) and grooving (33) of the lid are then carried out. Next the end of the body (30) is folded over in order to form a seam (35), thus completing the lid. After filling the body, a bottom comprising two cups (50', 70') and a seam (35') are installed, as previously. The body (30) and the external cups (50, 50) are made of the same rigid material.

This type of package is intended equally well for packaging chemicals, foodstuffs and other industrial products.

9 Claims, 4 Drawing Sheets

FIG. 2A
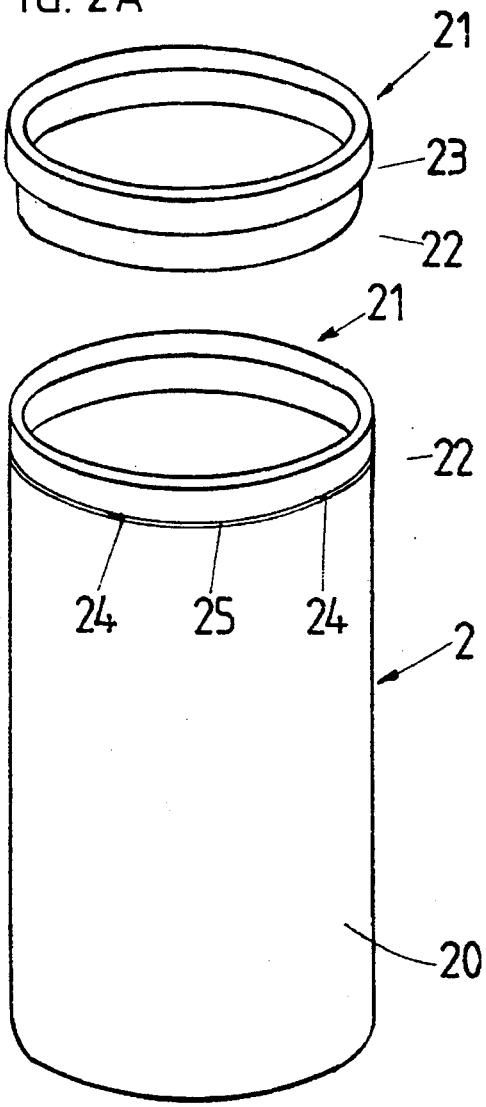
FIG. 2
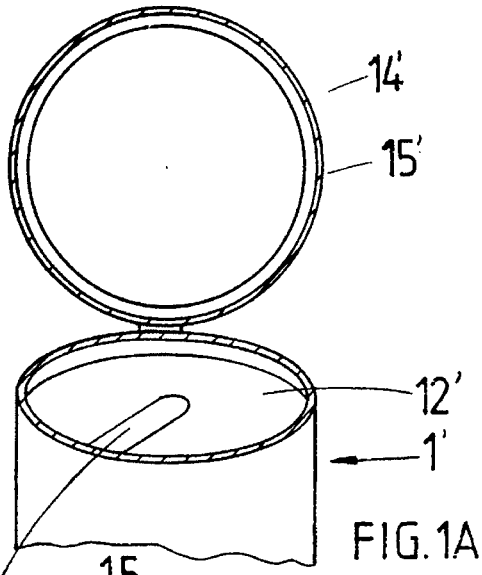
FIG. 1A
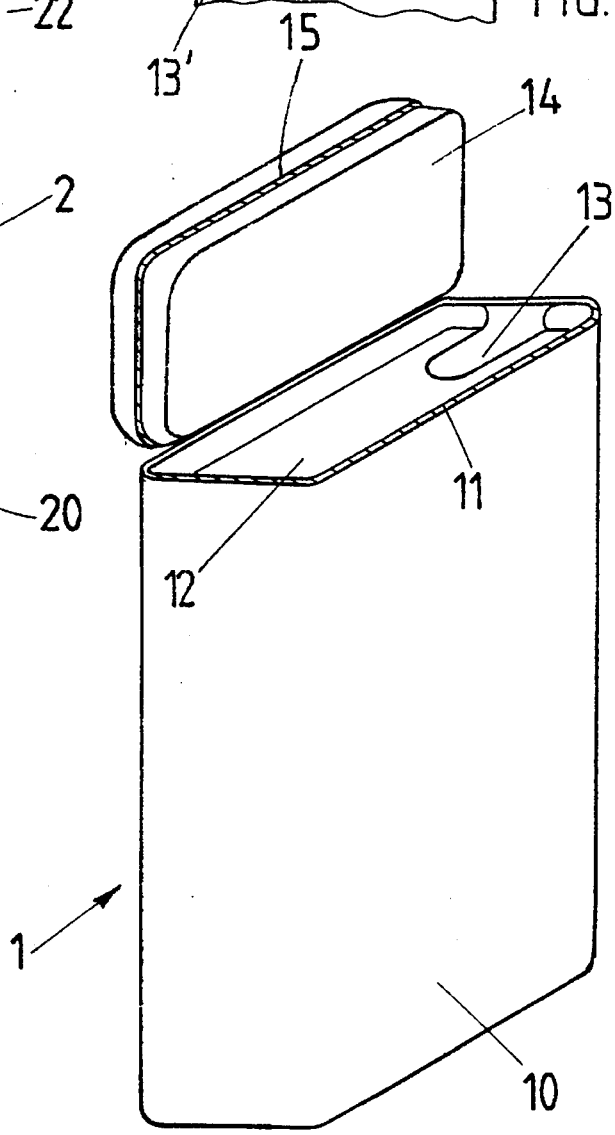
FIG. 1

PROCESS FOR MANUFACTURING A TUBULAR PACKAGE, AND PACKAGE OBTAINED BY THE IMPLEMENTATION OF THE PROCESS

FIELD OF THE INVENTION

The present invention relates to a process for manufacturing a tubular package having a tubular body made of a rigid material, and joined to the body, in an impermeable manner, are a bottom and a lid which are made of a material which is identical or similar to said rigid material, a diaphragm made of an identical or similar material being attached between the product and the lid.

The invention also relates to a package obtained by the implementation of the process.

PRIOR ART

Currently, mass-consumption products, relating especially to the food and chemical field are packaged in packages consisting of a plurality of materials and components.

The composite tubular packaging most often used comprises a body formed by a rigid material consisting of one or more layers of board, of an external label and of an internal complex intended to ensure by its composition, on the one hand, the impermeability of the package and, on the other hand, the compatibility of this complex with the product packaged. Very often this complex comprises a layer of paper, a layer of aluminum and a protective coating permitting neutral contact between the aluminum and the product. These packages often possess a metal bottom which is crimped onto the body after filling. The lid often consists of an aluminum membrane, providing a tamper-evident feature of the box, and of a press-in or hooded plastic lid enabling, on the one hand, the membrane to be protected before use and, on the other hand, the package to be resealed after extracting the membrane.

This type of package using several materials for manufacturing the main body, the bottom, the lid and the protective membrane has a relatively high cost and poses problems from an ecological standpoint, especially for waste disposal. In fact, in order to manufacture these packages, a device for forming the body is used, an aluminum membrane, which may or may not be provided with an easy-open system, is generally attached, and onto this membrane is placed a molded plastic lid having an appreciable weight, in order to obtain sufficient rigidity. The closure, after filling, is of the type involving the crimping of a metal (steel, tinplate or aluminum) bottom which is also produced on heavy and complicated machines. Thus, a strong package is obtained, but which is expensive and virtually impossible to recycle because of the various materials of which it is composed.

SUMMARY OF THE INVENTION

The object of the present invention is to overcome the abovementioned drawbacks by providing a process for manufacturing a package which is economical and environmentally friendly, easy to recycle and capable of packaging a very large number of foodstuffs, chemicals, industrial products, etc.

The process according to the invention is one wherein, after forming the tubular body, the following steps are carried out:

a) a first cup, which is the lid cup, is formed from a piece, cut out from a reel of a rigid material, by drawing by means of a male forming tool and an external die, b) a piece, cut out from a reel, is formed by drawing by means of the drawing tool for the lid cup and a second external die located on the path of said drawing tool between the external die used for drawing the lid cup and the tubular body, thus forming a second cup which is in contact with the lower face of the lid cup and at least over part of the height of the lateral surface of said lid cup, c) the combination of the two cups is simultaneously inserted by means of said male tool via one of the ends of the tubular body held from the outside, near said end, by jaws, d) at least the upper third of the side walls of the two cups are joined in an impermeable manner to the inner side wall of the body, e) the lateral surface of the tubular body is prescored along a peripheral line located between a first joint area for joining the first cup to the inner wall of the tubular body and a joint area for joining the second cup, the one forming said diaphragm, to the inner wall of the tubular body, thus providing for the opening of the lid without tearing the diaphragm, the prescoring being produced either along part of the peripheral line, if it is a package with a hinged lid, or right along it, if it is a package with a detachable lid, f) the folding-over (seaming) of the end of the tubular body is carried out by means of a folding-over plug, thus completing the manufacture of the lid, g) after turning the body over, it is filled with the product to be packaged, h) the second end of the tubular body is closed.

The advantages of the process according to the invention are as follows:

lower manufacturing cost, given that both the tubular body and the lid and bottom are made from similar materials, or indeed the same material, which preferably will be board, and that the manufacture of the package is formed continuously and with simple tooling, therefore saving time and cost of the means used;

the package is easy to recycle and therefore environmentally friendly, since its main parts are manufactured from the same material, or similar material and can be easily recycled without having to separate the elements made from different materials;

the package comprises, in addition to the rigid material, a diaphragm made of an identical or similar material which serves, according to one embodiment variant, as a protective membrane fixed between the lid and the product and, according to another variant, the diaphragm is perforated in order to permit, after having opened the package, dusting with the product contained.

The advantage of this embodiment is the fact that the diaphragm, whatever its function, is located just after the lid and it is produced, as regards its forming, virtually simultaneously with the lid cup and that it is also attached at the same time as the lid cup, thereby eliminating one additional operation since, currently, such a diaphragm is firstly attached and afterwards the plastic lid is put into place.

According to another variant of the process according to the invention, the lid, bottom and possible protective membranes on the inner surface of the tubular body are joined together by adhesive bonding, depositing, before inserting these elements, a bead of adhesive and, afterwards, inserting these elements and clamping the periphery of the body on a plug, and possibly heating, depending on the adhesive chosen.

Carrying out the process in this manner makes it possible, on the one hand, to make the package impermeable and, on the other hand, to have economical manufacture since this involves operations which may be performed very rapidly and simply.

According to another embodiment variant of the invention, the inner face of the tube of the tubular body which face may or may not be equipped with an inner complex, is coated with a plastic sealing film, this making it possible for joining to be achieved by the welding of the lid and bottom as well as of the possible protective membranes, by making said film react either by conductive heating, or by high-frequency heating, or by ultrasound or any other means, and also by applying compression.

According to other embodiment variants, the protective diaphragm located close to the lid also comprises a plastic sealing film only on its face on the product side so as to prevent it adhering to the lid, whereas the possible membrane lying on the bottom side of the package comprises a sealing film on both its faces.

According to a preferred embodiment variant, the plastic sealing film is compressed and made to react, as regards the joining of the lid and the diaphragm, in two areas spaced apart in the axial direction so as to prevent the protective membrane from adhering to the lid cup. Moreover, the prescoring, which follows the joining operation, is performed between these two joint areas.

The invention also relates to a package obtained by means of the process according to the invention.

In some cases, the inner complex may only consist of a sheet of paper or the like, compatible with the product to be packaged, or may contain a sheet of paper and a thin sheet of aluminum. Even in the latter case, recycling is made easier than before since the amount of aluminum is small compared to the rest of the package and the sheet of paper and the board may be recycled together. However, the use of aluminum will be preserved for products for which it turns out to be absolutely essential. It is also pointed out that the sealing film can easily be recycled with the rest of the package made of paper and board.

It is clear that, if the tubular body of the package, the cross section of which may equally well be polygonal as tubular, can be equipped with an external label or with a printed layer, the same label or layer can also be on the outer face of the lid, or even on the bottom.

BRIEF DESCRIPTION OF THE DRAWINGS

The invention will be described in more detail with the aid of the appended drawing.

FIG. 1 shows a package, with a hinged lid of rectangular cross section, open.

FIG. 1A shows partially a package, with a hinged lid of circular cross section, open.

FIG. 2 shows a package of circular cross section with a detachable lid.

FIG. 2 shows the lid of the previous package.

DESCRIPTION OF THE PREFERRED EMBODIMENTS

Figure 3:
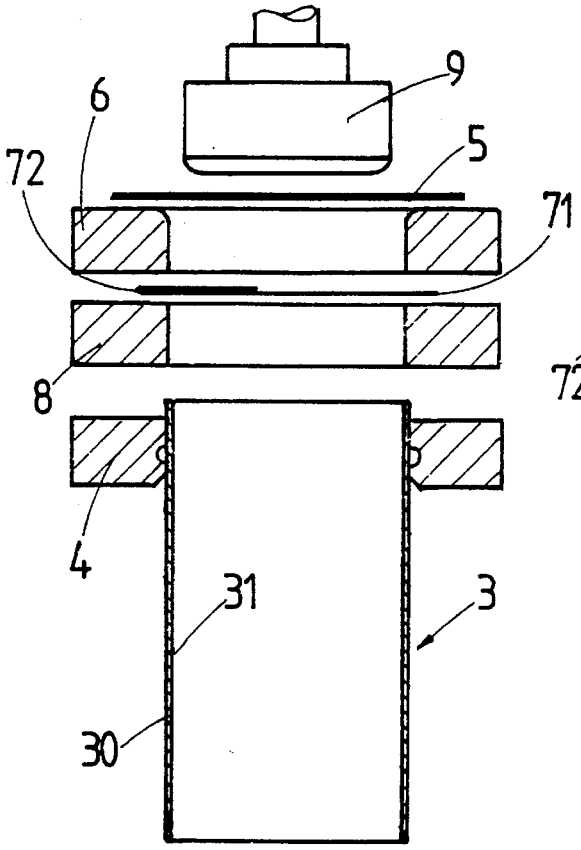
FIGS. 3, 4, 5 and 6 show diagrammatically, and in section, the successive drawing of the lid cup and of the diaphragm, and their simultaneous installation inside the tubular body.

We will now describe, with the aid of the appended drawing, the process for manufacturing a tubular package, according to the invention, comprising a diaphragm.

Depicted in FIG. 1 is a tubular package 1 having a tubular body 10, of rectangular cross section made of a rigid material 11 and closed by a protective membrane 12 equipped with an opening tab 13 which is integral or welded to the membrane 12, and a hinged lid comprising a cup 14 made of a rigid material which is at least similar to that of the tubular body 10 and comprising a surround 15 which is made from the tubular body 10 by prescoring and seaming, as will be seen below. The bottom of the package, which cannot be seen in FIG. 1, also has a cup similar to the cup 14 joined to the inner face of the body 10, the lower end of the body 10 also being folded over (seamed).

FIG. 1A depicts a partial view of a package comprising the same elements as the package of FIG. 1, the sole difference being the fact that it has a circular cross section. The same numerical references, with an accent (') designate the same elements.

In FIG. 2, we have depicted a package 2 of circular cross section comprising a tubular body 20 also made from a rigid material, such as board, closed by a lid 21 comprising a cup 22 formed by drawing a material which is at least similar to that of the tubular body 20, a surround 23 obtained by folding-over (seaming) the upper part of the tubular body 20, and prescoring 25. In FIG. 2, the points of discontinuity 24 may be distinguished in the prescoring 25 of the lateral surface of the main body 20 which provide a visible tamper-evident feature of the package. By breaking these points of discontinuity, the lid 21 may be moved away from the package which is preferably equipped with a protective membrane similar to the one in FIG. 1. The bottom of the package, not depicted in FIG. 2, is obtained in a similar manner to the one in FIG. 1.

These two package shapes are not limiting, although these are the shapes which are most often found on the market.

Figure 4:
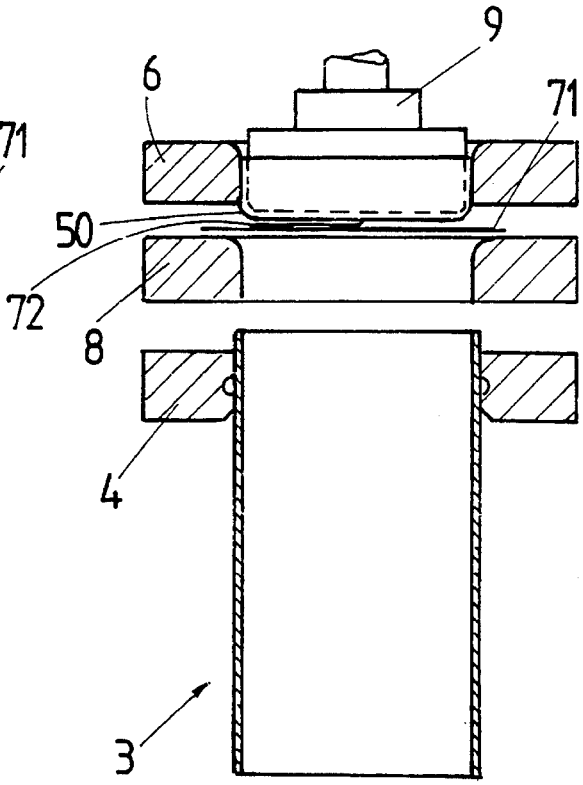
Figure 5:
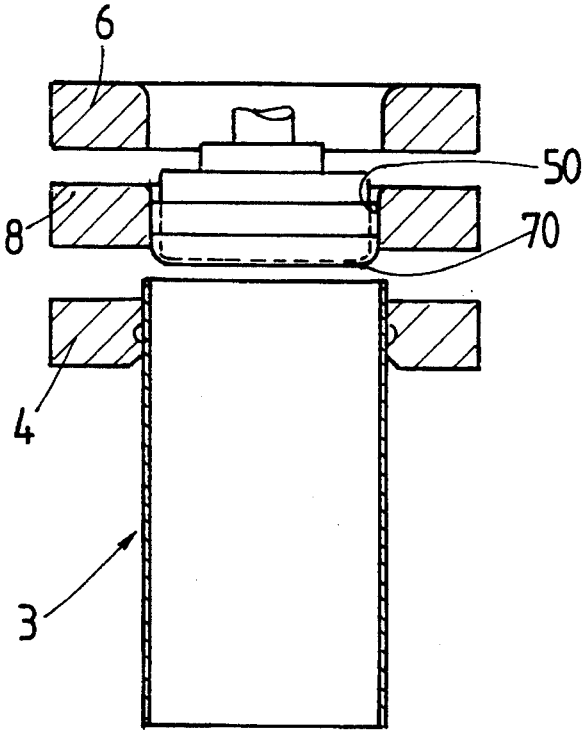
Figure 6:
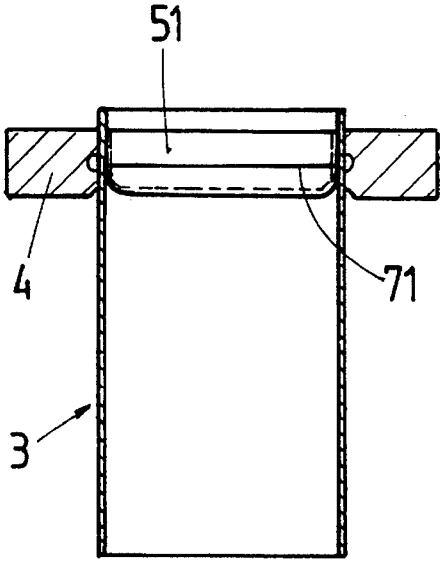

In FIG. 3, we have depicted a tubular body 3 made of a rigid material 30 and coated on its inner surface with a complex 31 consisting of at least one plastic sealing film. The tubular body 30 is manufactured by using known processes and means not forming the subject of the present invention. It is held around and near one of its ends by two jaws 4, holding and centering the body 3, while a piece 5, cut out from a reel of a material which is at least similar to the rigid material 30, is arranged on a die 6. Another piece 7, made of a thinner material such as paper, also cut out from a reel, and equipped with a tearing tab 72 which is adhesively bonded or welded to, or made as one piece with, the element 7, is arranged above a second die 8. By means of a male drawing member 9, possibly equipped with a heating means, the successive drawing of the piece 5 in order to form a cup 50 (FIG. 4) and of the piece 7 passing through the die 8, in order to form a second cup 70 (FIG. 5), are carried out and these two superposed cups 50, 70 are placed inside the body 3 facing the jaws 4 (FIG. 6).

It is important to point out at this stage that the dimensions of the pieces 5 and 7 are chosen so that the lateral surface 51 of the cup 50 formed by the piece 5 is higher than the lateral surface 71 of the cup 70 formed by the piece 7. As will be seen below, this characteristic makes it easier to separate the lid from the protective membrane.

Figure 7:
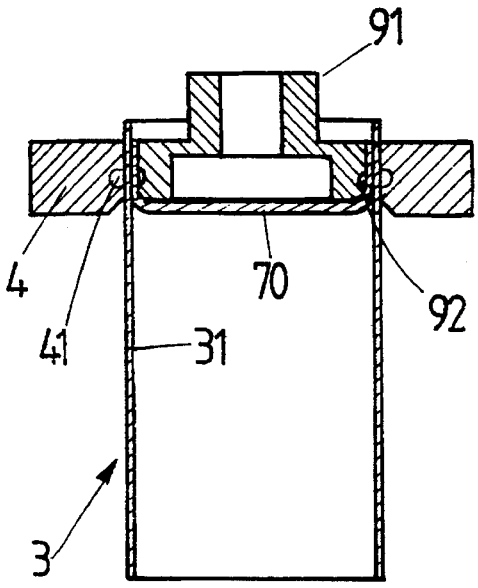
FIG. 7 is a diagrammatic view, in section, showing the joining of the lid cup and of the diaphragm.

Next, the two cups 50, 70 are joined to the inner lateral surface of the body 3 (FIG. 7) by means of a plug 91, against which the jaws 4 clamp the combination of the tubular body 3 and the cups 50, 70, and by making the plastic sealing film react either by convective heating or by high-frequency heating or by ultrasound or any other known means. During this reaction period, the plastic film 31 melts, this enabling the lateral surface of the cup 50 to be welded to the inner lateral surface of the body 3 and the lateral surface 71 of the cup 70 to be welded to the inner surface of the body 3. It is important to emphasize that the die 4 is equipped with a groove 41 and the plug 91 with a groove 92 whose purpose is to prevent the pressure from being exerted along these grooves on the contacting surfaces and also to prevent the film 31 from melting at this point so as to prevent the cup 70 from possibly being joined to the cup 50. It should be noted that the cup 50 is joined to the inner wall of the body preferably along the upper third of its lateral surface in order, especially, to prevent the two cups 50 and 70 from being welded to each other and in order to make the prescoring easier.

According to a preferred variant, the piece 7 is also equipped on its surface on the inside of the package with a plastic sealing film, this making it possible, during reacting, to obtain an impermeable joint of better quality between the piece 70 and the inner surface of the tubular body 3.

Figure 8:
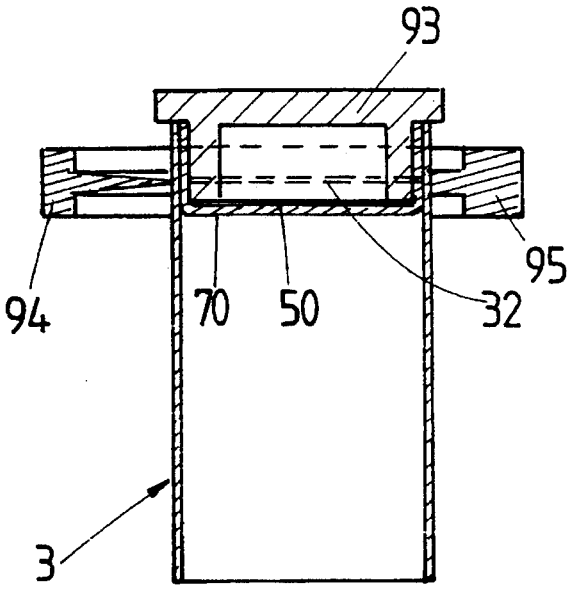
FIG. 8 shows diagrammatically, and in section, the prescoring of the lateral surface of the tubular body.

After the operation of joining the two cups 70 and 50 to the inner face of the body 3, it is then necessary to carry out the prescoring of the lateral surface of the body 3 along a peripheral line 32 (FIG. 8) located at the position of the two grooves 41 and 92 mentioned previously. In order to do this, use is made, on the one hand, of an internal plug 93 having the shape and size of the cup 50 and, on the other hand, a cutter 94. However, the prescoring is not produced all the way along this line when a hinged lid is involved, the assembly 95 providing overall integrity.

It is obvious that this prescoring is also made with certain discontinuities which provide the tamper-evident feature of the box and so as to prevent untimely opening of the lid. Depending on the rigid material used, it is possible to avoid this grooving, the hinge being formed on opening the box, as for example for the package of FIG. 1A.

Figure 9:
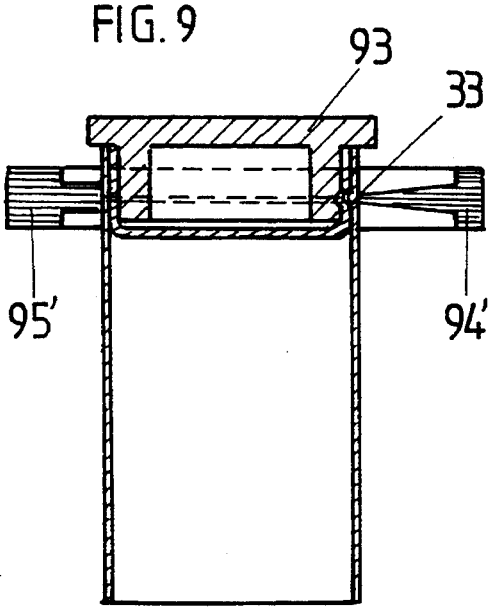
FIG. 9 shows, in section and diagrammatically, the grooving of the lateral surface of the tubular body in order to create f hinged lid.
Figure 10:
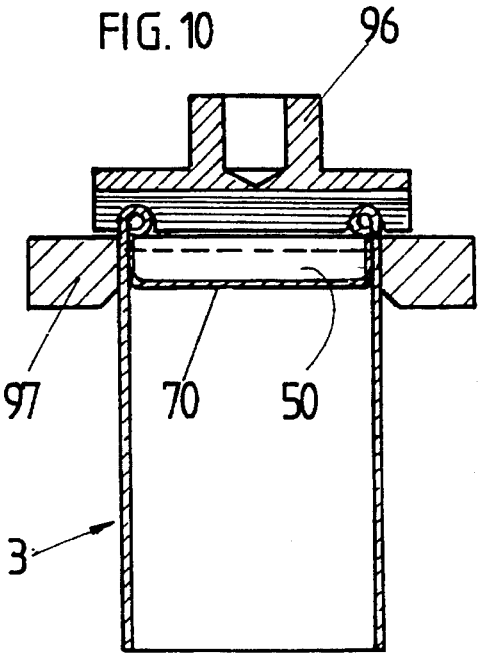
FIG. 10 is a diagrammatic view, in section, showing the inward folding-over (seaming) of the end of the tubular body, thus completing the formation of the lid.

Next (FIG. 9), a notch 33 is created, by means of a member 94' similar to the member 94, on the tubular body 3 intended to act as a hinge for the lid. Depending on the rigid material used, it is possible to avoid grooving, the hinge being formed on first opening the box and grooving is not necessary.

At the next step, the upper end of the tubular body 3 is folded over by means of a member 96, this operation being commonly called seaming. The member 96 is also preferably heated in order to ensure good quality of the seaming. The body 3 is held in place by jaws 97. After this operation, the lid of the package is formed by the cup 50 attached by welding against the inner face of the tube 3 via the folded-over part, while the cup 70, independently attached to the inner face of the tubular body 3, forms the protective membrane. On breaking the points of discontinuity, it is possible to open the lid and reach a situation such as that of FIG. 1 or, if it is a hingeless lid, to obtain the situation of FIG. 2.

After having terminated one of the ends of the package, the box is filled, at this place or at another place, with the product to be packaged via the other end, and therefore by turning the box over. Next, the bottom of the package is installed by repeating the operations of FIGS. 3, 4, 5 and 6, save that the bottom may be attached directly without the cup corresponding to the cup 70 when the material of the bottom is compatible with the product to be packaged. In the case where a protective cup is necessary, in order to provide impermeability and compatibility with the product to be packaged, the piece which will form the cup is equipped with a sealing film on both its faces so as to enable it to adhere both to the lateral face of the cup forming the bottom and the inner face of the body 3 (see FIG. 11). In this case, both cups, the one made of rigid material and the one equipped with the sealing film, have exactly the same dimensions.

The package may have a bottom which is joined to the body by other means.

In the case of joining various cups to the inner face of the tubular body 3 by adhesive bonding, before inserting the cups into the body, an adhesive bead is put into place, which adhesive bead is laminated on inserting the cups and provides the adhesion of the respective cups by pressure and, possibly, heating. In this case, it is obvious that the protective membrane can adhere by the upper edge of its lateral surface 71 to the cup 50 forming the lid, and in this case the prescoring must be carried out more accurately so as to separate the part adhesively bonded to the surface 51 from the cup 50, in order to prevent, when opening the package, the protective membrane from tearing.

Figure 11:
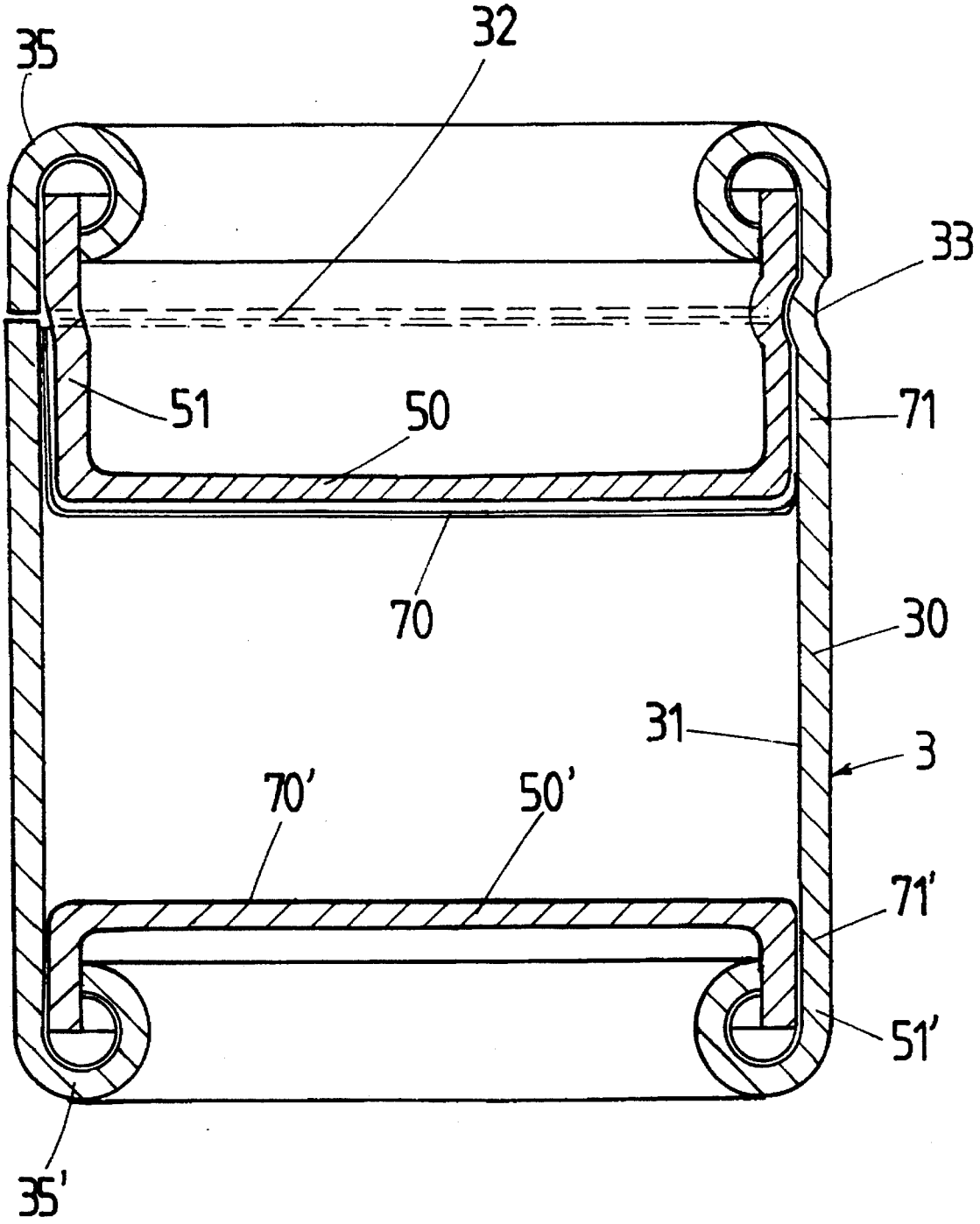
FIG. 11 is a view, in section and on an enlarged scale, of a hinged package without the packaged product.

In FIG. 11, we have presented a package, in section, showing in detail the various elements of the package constructed according to the process of the present invention. Thus, we encounter again the tubular body 3 having a rigid body 30, an inner complex 31 with a sealing film, the protective membrane of the cup 70 with the tearing tab 72, welded by its lateral surface 71 to the inner face of the tubular body 3, while the lateral surface 51 of the cup 50 made of rigid material is welded along the part extending beyond the lateral surface of the cup 70, also on the inner surface of the body 3. The upper part of the body 3 is folded over inward, forming a seam 35 constituting, after prescoring along the line 32, the lid of the package. In this figure may be seen the grooving 33 intended to form the opening hinge, in this case it being a hinged package.

The lower part of the box comprises a cup 50', made of a rigid material which is at least similar to that of the cup 50, and a cup 70' forming a protective membrane similar to the cup 70 except that this cup 70' has the same dimensions as the cup 50' and these are formed simultaneously before insertion into the body.

It should be noted that, when the tab 13 or 72 is integral with the piece 7, its face folded over toward the lid is coated with a paper in order to prevent the tab from adhering during the operation of welding to the lid and that it is equipped with a sealing film just on one face. A seam 35' also finishes off the package. In order to avoid putting down a coating paper, the tab may be longer and will be folded over on itself in order to prevent the coated face of the film from adhering to the lid.

If the diaphragm is a cap, perforated in order to permit dusting with the product contained in the package, the manufacturing process is the same, save that the diaphragm cup is perforated and is made of a more rigid material.

I claim:

1. A process for manufacturing a tubular package having a tubular body made of a rigid material, a bottom and a lid joined to said body in an impermeable manner, a diaphragm attached between said body and lid, said bottom, lid and diaphragm made of the same or similar rigid material as said body, the process comprising the steps of:

(1) forming said body;

(2) forming a first lid cup from a piece cut from a reel of rigid material by drawing said material using a male forming tool and a first external die;

(3) forming a second lid cup from a piece cut from a reel of a second material by drawing said second material using said drawing tool for forming said first lid cup and a second external die located on a path of said drawing tool between said first external die and said tubular body, said forming step for forming said second lid cup includes the step of forming said second cup to contact a lower face of the first cup at least over part of the height of the lateral surface thereof;

(4) inserting simultaneously the combination of first and second lid cups in a first end of said body using said male tool via one of the ends of said tubular body held from the outside, near said end by jaws, (5) joining at least the upper third of said walls of the first and second cups in an impermeable manner to the inner side wall of the body, (6) prescoring the lateral surface of the tubular body along a peripheral line located between a first joint area for joining said first cup to the inner wall of the tubular body and a joint area for joining said second cup, the one forming said diaphragm, to the inner wall of the tubular body, (7) providing for opening of the lid without tearing said diaphragm, said step of prescoring being selectively produced either along part of the peripheral line if it is a package with a hinged lid, or right along it, if it is a package with a detachable lid, (8) folding over said first end of the tubular body by means of a folding over plug thereby completing the manufacture of the lid, (9) turning the body over and filling it with product to be packaged, and

(10) closing the second end of the tubular body.

2. The process of claim wherein the non-prescored part is notched in order to make the lid easier to pivot for packages with a hinged lid.

3. The process of claim 1 further comprising the step of joining the lid, bottom and diaphragm on the inner surface of the tubular body by adhesive bonding, said step of joining includes the step of (1) depositing a bead of adhesive prior to inserting said lid, bottom and diaphragm and after said inserting, (2) clamping the body, from the outside, against an internal plug and selectively heating said adhesive.

4. The process as claimed in claim 1 further comprising the step of equipping the tubular body on its inner face with a plastic sealing film and joining said lid, bottom and diaphragm by clamping the body, from the outside, against an internal plug and making said sealing film react.

5. The process of claim 4 further comprising the steps of equipping the diaphragm with a sealing ring on its surface lying on the inside of the package and equipping a membrane located at the bottom of the package with a plastic sealing film on both of its surfaces, thus permitting adhesion both to the bottom and to the inner lateral surface of the tubular body.

6. The process of claim 4 further comprising the step of making said plastic sealing film react by application of high frequency or ultrasound.

7. The process of claim 4 further comprising the step of making said plastic sealing film react conducting of heat by means of an element heating through the elements to be assembled.

8. The process of claim 4 further comprising the steps of pressing the plastic sealing film and making it react along two peripheral areas spaced apart in the axial direction of the tubular body relating to the region of the lid so as to prevent the upper surface of the diaphragm from being joined to the lid cup.

9. The process of claim 1 further including the step of repeating steps 1, 3, 4 and 7.

* * * * *